US005694801A

United States Patent [19]

Takahashi et al.

[11] Patent Number: 5,694,801

[45] Date of Patent: Dec. 9, 1997

[54] BENDING PRESS SYSTEM

[75] Inventors: Hideaki Takahashi; Shigeo Koyama, both of Kanagawa, Japan

[73] Assignee: Amada Company, Limited, Kanagawa, Japan

[21] Appl. No.: 547,193

[22] Filed: Oct. 24, 1995

Related U.S. Application Data

[63] Continuation of Ser. No. 187,718, Jan. 28, 1994, abandoned.

[30] Foreign Application Priority Data

Jan. 29, 1993 [JP] Japan ..... 5-013769

[51] Int. Cl.[6] ..... B21D 5/04

[52] U.S. Cl. ..... 72/319; 72/323; 72/405.02

[58] Field of Search ..... 72/319–323, 306, 72/405.01, 405.02

[56] References Cited

U.S. PATENT DOCUMENTS

| | | | |
|---|---|---|---|
| 674,908 | 5/1901 | Dreisvogt | 72/319 |
| 829,597 | 8/1906 | Ohl | 72/319 |
| 1,135,534 | 4/1915 | Kruse | 72/322 |
| 1,387,603 | 8/1921 | McCabe . | |
| 1,872,670 | 8/1932 | Burns | 72/306 |
| 2,181,566 | 11/1939 | Jensen | 72/319 |
| 2,569,181 | 9/1951 | Laxo . | |
| 2,734,552 | 2/1956 | Yonash | 72/322 |
| 2,847,051 | 8/1958 | Renard . | |
| 3,058,512 | 10/1962 | Chebuhar et al. . | |
| 3,344,633 | 10/1967 | Wilson . | |
| 3,731,514 | 5/1973 | Deibele, Jr. | 72/306 |
| 3,786,666 | 1/1974 | York, Jr. | 72/320 |

(List continued on next page.)

FOREIGN PATENT DOCUMENTS

| | | | |
|---|---|---|---|
| 2187445 | 1/1974 | France . | |
| 2364709 | 4/1978 | France . | |
| 63-60021 | 3/1988 | Japan . | |
| 63220926 | 9/1988 | Japan . | |
| 63220927 | 9/1988 | Japan . | |
| 63220928 | 9/1988 | Japan . | |
| 1289513 | 11/1989 | Japan . | |
| 241621 | 9/1990 | Japan | 72/319 |
| 2274317 | 11/1990 | Japan . | |
| 274317 | 11/1990 | Japan | 72/319 |
| 190925 | 7/1992 | Japan | 72/306 |
| 192712 | 8/1993 | Japan | 72/306 |
| 0216009 | 12/1941 | Switzerland . | |

OTHER PUBLICATIONS

English language abstract of Japanese Patent Publication No. 1–289,513.

English language abstract of Japanese Patent Publication No. 63–60,021.

English language abstract of Japanese Patent Publication No. 63–220,927.

English language abstract of Japanese Patent Publication No. 63–220,928.

English language abstract of Japanese Patent Publication No. 63–220,926.

English language abstract of Japanese Patent Publication No. 2–274,317.

*Primary Examiner*—Daniel C. Crane

*Attorney, Agent, or Firm*—Greenblum & Bernstein, P.L.C.

[57] ABSTRACT

A bending apparatus includes: an upper bending die 63U for downward bending both ends of the plate material gripped between upper and lower plates 59U and 59L provided on upper and lower frames 35U and 35L, respectively and a lower bending die 63L for upward bending both ends of the same plate material; and upper and lower bending mechanisms each including a link mechanism for moving the upper bending die or the lower bending die in both upward or downward direction, respectively. In the bending apparatus according to the present invention, since the upper and lower bending mechanisms 61U and 61L are constructed by a link mechanism, respectively, it is possible to move the upper or lower bending die 63U or 63L far away from the bending position of the plate material W.

10 Claims, 7 Drawing Sheets

U.S. PATENT DOCUMENTS

| | | | |
|---|---|---|---|
| 4,004,333 | 1/1977 | Daniels | 83/413 |
| 4,055,066 | 10/1977 | Lamendour . | |
| 4,242,898 | 1/1981 | Salvagnini | 72/307 |
| 4,356,716 | 11/1982 | Aschauer | 72/322 |
| 4,385,513 | 5/1983 | Salvagnini | 72/320 |
| 4,411,148 | 10/1983 | Aschauer et al. | 72/306 |
| 4,455,857 | 6/1984 | Salvagnini | 72/320 |
| 4,783,984 | 11/1988 | Aschauer | 72/319 |
| 4,843,862 | 7/1989 | Salvagnini | 72/319 |

BENDING PRESS SYSTEM

This application is a continuation of application Ser. No. 08/187,718, filed Jan. 28, 1994, now abandoned.

BACKGROUND OF THE INVENTION

1. Field of the Invention

The present invention relates to a plate material bending apparatus.

A plate material is gripped by an lower plate mounted on a lower frame and an upper plate mounted on a vertically movable upper frame; and an upper die holder for holding an upper bending die to bend downward an end portion of the gripped plate material and a lower die holder for holing a lower bending die to bend upward the end portion of the same gripped plate material are provided so as to be movable vertically. More specifically, the present invention relates to a plate material bending apparatus, by which the upper bending die, for instance can be retreated markedly from the bending position where a bending is performed. The bending die is moved in roughly rectilinear motion to the bending position during the bending processing; and after the end portion of the plate material has been bent at roughly a right angle, the bending die is moved along a curved locus so as to further bend the plate material (referred to as overbending).

2. Description of the Prior Art

As the prior art examples related to the plate material bending apparatus of the present invention, there have been known U.S. patent application Ser. Nos. 4,242,898; 4,356,716; 4,385,513; 4,458,857; 4,783,984; 4,843,862; 4,411,148, and Japanese Laid Open Patent Application Nos. 1-289,513; 63-60,021; 63-220,927; 63-220,928; 63-220,926; 2-274,317; and French Patent Application No. 2,187,445.

The above-mentioned prior art of plate material bending apparatuses can be divided into tow types as follows: In the first type, the upper bending die and the lower bending die are arranged on a channel-shaped holder in such a way that both the dies are opposed to each other in the vertical direction. In the second type, the upper bending die and the lower bending die are mounted on an upper holder and a lower holder, separately.

In the above-mentioned apparatuses, after the end portion of a plate material gripped between the upper plate and the lower plate has been bent in the vertical direction by moving the holder in the vertical direction, the holder is further moved slightly in the horizontal direction to achieve the overbending processing. In other words, the prior apparatus is generally provided with a driving unit for moving the holder in the vertical direction and another driving unit for moving the holder in the horizontal direction, respectively, thus raising a problem in that the construction of the apparatus is complicated and therefore costly.

A plate material bending apparatus which can move the holder in the vertical direction and further slightly in the horizontal direction by a single motor is disclosed in U.S. patent application Ser. No. 4,356,716, for instance. In the prior art apparatus of this construction, however, since the mechanism is such that the holder is moved fairly in the vertical direction and slightly in the horizontal direction by driving two different eccentric mechanisms simultaneously, it is impossible to sufficiently retreat the bending die in the vertical direction from the bending position by moving the holder.

Further, since the locus of the bending die is determined by synthesizing the motion of one eccentric mechanism for moving the holder in the vertical direction and the motion of the other eccentric mechanism for moving the holder in the horizontal direction, it is difficult to set the locus of the bending die accurately during the overbending operation.

SUMMARY OF THE INVENTION

With these problems in mind therefore, it is the first object of the present invention to provide a plate material bending apparatus, by which both the vertical movement of the bending die to bend an end portion of a plate material and the overbending movement of the bending die required after the completion of bending of the end portion of the plate material to a right angle are obtained continuously by use of a link mechanism.

Further, the second object of the present invention is to provide a plate material bending apparatus, by which the bending die can be retreated markedly in the vertical direction from the plate material bending position.

Furthermore, the third object of the present invention is to provide a plate material bending apparatus, by which a clearance between the upper and lower plates for gripping a plate material therebetween and the bending die can be adjusted according to the thickness of the plate material to be bent.

Fourth object of the present invention is to provide a plate material bending apparatus, by which the flection of the bending die can be adjusted and corrected.

The plate material bending apparatus according to the present invention includes: a lower frame having a lower plate; an upper frame having an upper plate, supported by said lower frame so as to be movable up and down; an upper bending die for downward bending both sides of a plate material gripped between the lower plate and the upper plate; a upper link mechanism for moving the upper die in upward and downward directions; a lower bending die for upward bending both side ends of the same plate material; a lower link mechanism for moving the lower die in upward and downward directions.

The plate bending apparatus according to the present invention preferably further includes a clearance adjusting apparatus for adjusting a clearance between said upper or lower plate and the upper or lower bending die according to a thickness of the plate material to be bent.

The plate bending apparatus according to the present invention preferably further includes a compensation apparatus for compensating deformation to be generated in said upper and lower dies during a bending processing.

Further, the bending apparatus according to the present invention preferably includes: a lower frame; an upper frame provided on said lower frame so as to be movable up and down; a lower plate mounted on said lower frame; an upper plate mounted on said upper frame to grip the plate material in cooperation with said lower plate; an upper bending die for bending an end portion of the plate material gripped between said upper and lower plates in downward direction; an upper die holder for holding said upper bending die; a plurality of upper guide links oscillatorily movable up and down, front end portions of said upper guide links being pivotally connected to a lower portion of said upper die holder, respectively; a plurality of upper crank arms pivotally connected to an upper portion of said upper die holder, for moving said upper die holder up and down; and an upper driving device for moving the respective upper crank arms, and wherein when said respective upper crank arms are moved, said upper die holder is moved down, while being guided by said respective upper guide links, to bend the end portion of the plate material downward; and when said respective upper crank arms are further moved in the same direction, an end portion of said upper bending die is pivoted toward under said lower plate about pivot shafts between said respective upper guide links and said upper die holder to overbend the same plate material; and the apparatus further including: a lower bending die for bending the end portion of the plate material gripped between said upper and lower plates in upward direction; a lower die holder for holding said lower bending die; a plurality of lower guide links oscillatorily movable up and down, end portions of said lower guide links being pivotally connected to an upper portion of said lower die holder, respectively; a plurality of lower crank arms pivotally connected to a lower portion of said lower die holder, for moving said lower die holder up and down; and a lower driving device for moving the respective lower crank arms, and wherein when said respective lower crank arms are moved, said lower die holder is moved up, while being guided by said respective lower guide links, to bend the end portion of the plate material upward; and when said respective lower crank arms are further moved in the same direction, an end portion of said lower bending die is pivoted toward above said upper plate about pivot shafts between said respective lower guide links and said lower die holder to overbend the same plate material further upward.

In the bending apparatus of the present invention, a length of said upper guide links is longer than that of said lower guide links, and an upward movement stroke of said upper die holder is longer than a downward movement stroke of said lower die holder.

Further, the bending apparatus of the present invention preferably further includes: a plurality of upper support brackets movably mounted on said upper frame, and pivotally connected to base portions of a plurality of said upper guide links, respectively, for adjusting a clearance between said upper or lower plate and the upper bending die according to thickness of the plate material to be bent; and a plurality of lower support brackets movably mounted on said lower frame, and pivotally connected to base portions of a plurality of said lower guide links, respectively, for adjusting a clearance between said upper or lower plate and the lower bending die according to thickness of the plate material to be bent.

The apparatus of the present invention preferably further includes: a plurality of upper support brackets movably mounted on said upper frame so as to be slidably mounted on said upper frame independently, and pivotally connected to base portions of a plurality of said upper guide links, respectively, for adjusting a flection of said upper bending die; and a plurality of lower support brackets movably mounted on said lower frame so as to be slidably mounted on said lower frame independently, and pivotally connected to base portions of a plurality of said lower guide links, respectively, for adjusting a flection of said lower bending die.

DETAILED DESCRIPTION OF THE PREFERRED EMBODIMENTS

A plate material bending system including a bending apparatus according to the present invention will be described hereinbelow with reference to FIG. 1. The bending system 1 includes a first bending line 3 for conveying a plate material W in a first direction; a second bending line 5 for conveying the same plate material W in a second direction perpendicular to the first direction; and a plate material feeding apparatus 7 for feeding the plate material W from the first bending line to the second bending line without changing the orientation of the plate material W.

Figure 1:
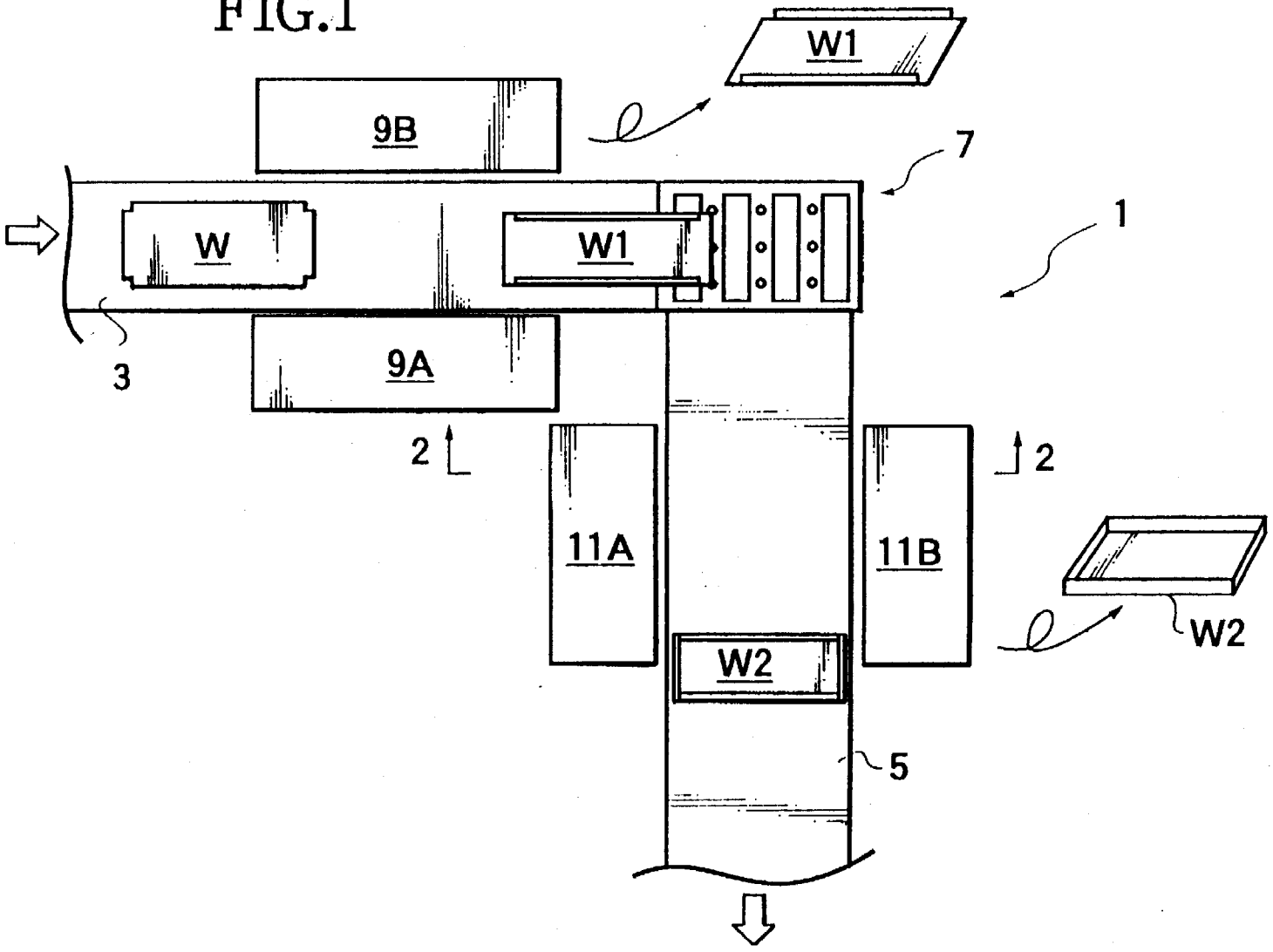
FIG. 1 is a schematic plane view showing a plate material bending system including a bending apparatus according to the present invention.

As shown in FIG. 1, on both sides of the first bending line 3, a pair of first bending apparatuses 9A and 9B are arranged so as to be opposed to each other for bending one pair of two opposing sides of the plate material W (the upper and lower sides of the material W in FIG. 1). These first bending apparatuses 9A and 9B are movable relatively toward and away from each other, as described later.

Further, on both sides of the second bending line 5, a pair of second bending apparatuses 11A and 11B are arranged so as to be opposed to each other for bending the other pair of two opposing sides of the plate material W1 (the right and left sides of the material W in FIG. 1). These second bending apparatuses 11A and 11B are also movable relatively toward and away from each other, in the same way as with the case of the first bending apparatuses 9A and 9B.

The plate material feeding apparatus 7 is provided with such a function as to feed the plate material W1 carried from the left side along the first bending line 3 after being bent on one pair of two opposing sides thereof by the first bending apparatuses 9A and 9B, toward the second bending line 5 without changing the direction of the plate material W.

The plate material feeding apparatus 7 can be constructed by combining a plurality of rollers or conveyers for conveying the plate material W in the right and left direction (the horizontal direction in FIG. 1) and a plurality of rollers or conveyers for conveying the same material in the front and rear direction (the vertical direction in FIG. 1). Since these mechanisms are well known, any detailed description of the plate material feeding apparatus 7 is omitted herein.

Figure 2:
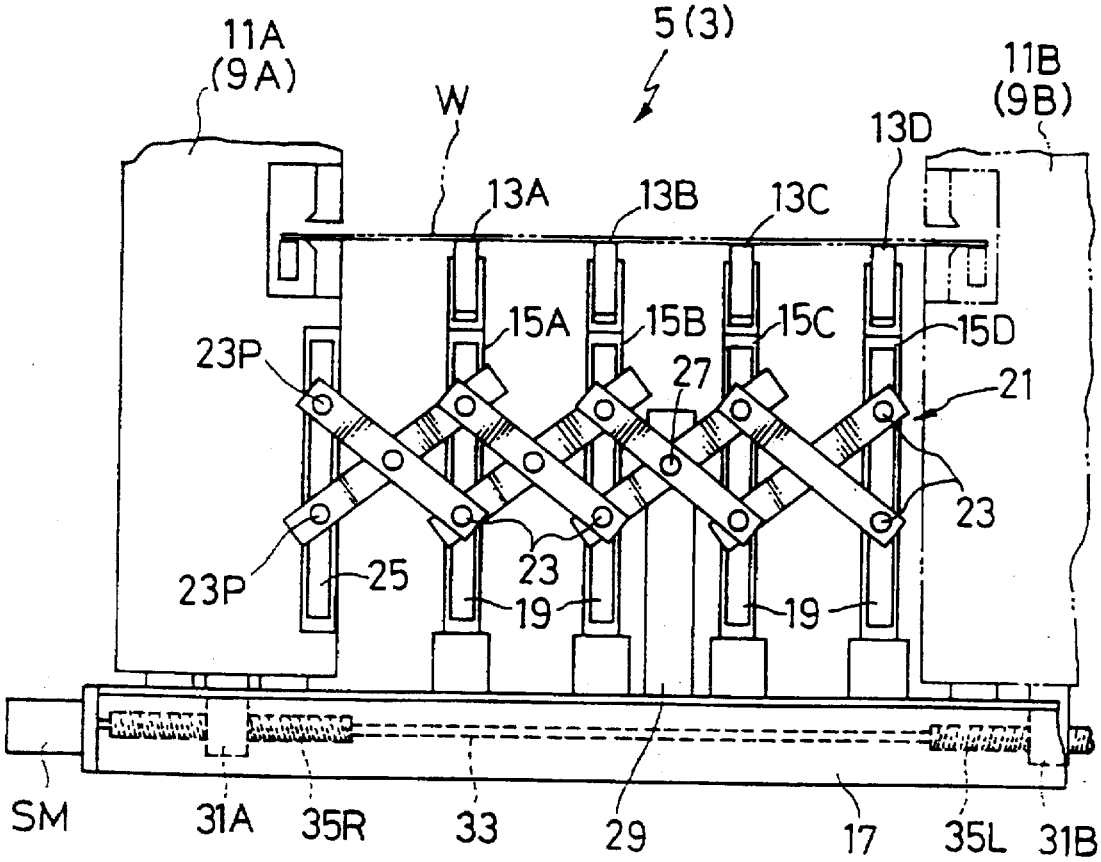
FIG. 2 is a cross-sectional view taken along the line 2—2 shown in FIG. 1.

As shown in FIG. 2, each of the first and second bending lines 3 and 5 is composed of a plurality of belt conveyers 13A to 13D whose intervals can be adjusted.

In more detail with reference to FIG. 2, the belt conveyers 13A to 13D are supported by a plurality of support brackets 15A to 15D, respectively. These brackets 15A to 15D are further supported by a guide rail 17 so as to be movable in the right and left direction in FIG. 2. Further, each of the brackets 15A to 15D is formed with a vertically extending slit 19, respectively, and link pins 23 of a cross-link mechanism 21 are slidably engaged with these slits 19 of the brackets 15A to 15D, respectively.

Two end link pins 23p provided on one end of the cross-link mechanism 21 are engaged with a vertical slit 25 formed in one end of the bending apparatus 11A (9A).

Further, a central pin 27 of the cross-link mechanism 21 is fixed to a fixed member (e.g., a post fixed to the floor).

In order to adjust the intervals between the respective belt conveyers 13A to 13D of the first or second bending line 3 or 5 or to adjust the interval between the first or second two bending apparatuses 9A and 9B or 11A and 11B according to the width of flanges to be formed at the ends of the material W by the bending apparatuses, two nut members 31A and 31B are provided in the two bending apparatuses 9A and 9B or 11A or 11B, respectively so that the two opposing bending apparatuses can be moved relatively toward and away from each other.

Further, a rotary shaft 33 formed with a right hand screw 35R and a left hand screw 35L on both ends thereof is engaged with the two nut members 31A and 31B, and further a servomotor SM is coupled to the rotary shaft 33.

Accordingly, when the servomotor 33 is controllably rotated through an appropriate angle, it is possible to move the two opposing boring apparatuses 9A and 9B or 11A or 11B toward and away from each other. Here, when the interval between the two bending apparatuses 9A and 9B or 11A and 11B is adjusted, the intervals between the respective belt conveyers 13A to 13D of the first or second bending line 3 or 5 are also adjusted through the cross-link mechanism 21. In other words, it is possible to simultaneously adjust the interval between the two bending apparatuses 9A and 9B or 11A and 11B and the intervals between the respective belt conveyers 13A to 13D according to the width of flanges to be formed at the ends of the plate material W.

In the plate material bending system as described above, the intervals between the respective belt conveyers 13A to 13D of the first bending line 3 and the interval between the two opposing bending apparatuses 9A and 9B can be adjusted according to the width of the flanges to be formed at the ends of the plate material W (i.e. the upper and lower ends in FIG. 1) conveyed along the first bending line 3. One pair of the two opposing sides (vertical direction in FIG. 1) of the plate material W are bent simultaneously by the first bending apparatuses 9A and 9B.

Thereafter, the bent plate material W1 is further conveyed to the plate material feeding apparatus 7. In this case, the plate material W1 is fed to the second bending line 5 as the plate material W2 through the feeding apparatus 7 without changing the direction of the plate material Further, the intervals between the respective belt conveyers 13A to 13D of the second bending line 5 and the interval between the two opposing bending apparatuses 11A and 11B can be adjusted according to the width of the flanges to be formed at the ends of the material W2 (i.e. the right and left ends in FIG. 1) of the plate material W1 conveyed along the first bending line 5. Further, the other pair of the two opposing sides (horizontal direction in FIG. 1) of the plate material W1 are bent simultaneously by the second bending apparatuses 11A and 11B. The plate material W2 thus bent are conveyed to the succeeding manufacturing process.

In the above-mentioned bending system, since two pairs of the two opposing sides of the plate material W can be bent simultaneously without reversing the front and rear direction of the plate material W, it is possible to improve the bending efficiency markedly.

Further, since one pair of the two opposing sides and the other pair of the two opposing sides of the plate material W can be bent by the two different bending lines and 5, it is possible to bend the four sides of the plate material W in any desired sequence, irrespective of the long and short sides of the plate material W. When the long sides of the plate material are first bent in particular, since the short sides can be bent on the basis of the bent long sides, it is possible to increase the rectangularity of the bent plate material W.

The first and second bending apparatuses 9A and 9B or 11A and 11B arranged on both sides of the first or second bending line 3 or 5 in order to bend the plate material W are each constructed as described hereinbelow. Here, since the respective bending apparatuses are the same in construction, only the bending apparatus 11B will be described hereinbelow in detail with reference to the attached drawings.

Figure 3:
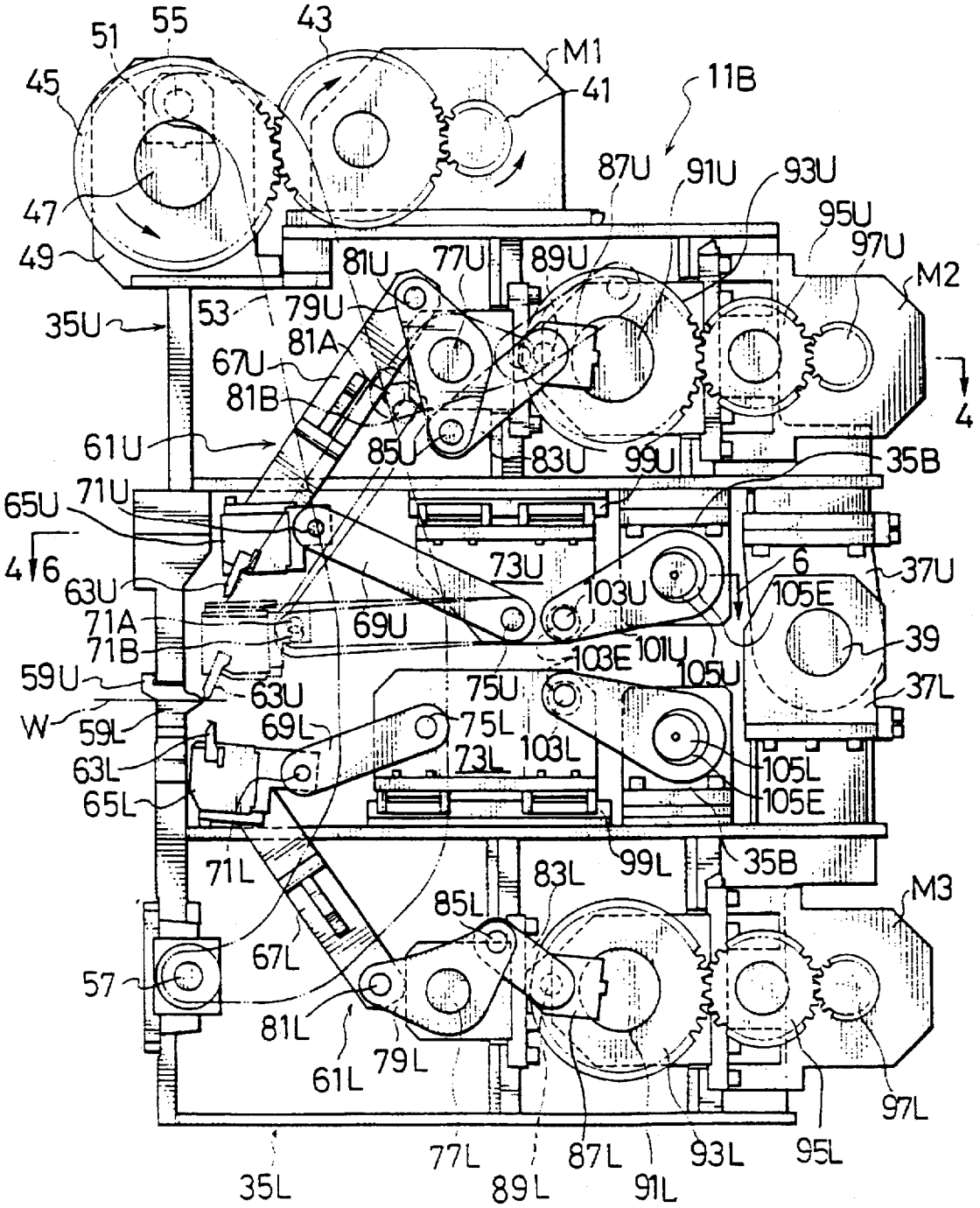
FIG. 3 is a side sectional view showing the plate material bending apparatus of the present invention, in which a plate material W to be bent is gripped from above and below.
Figure 4:
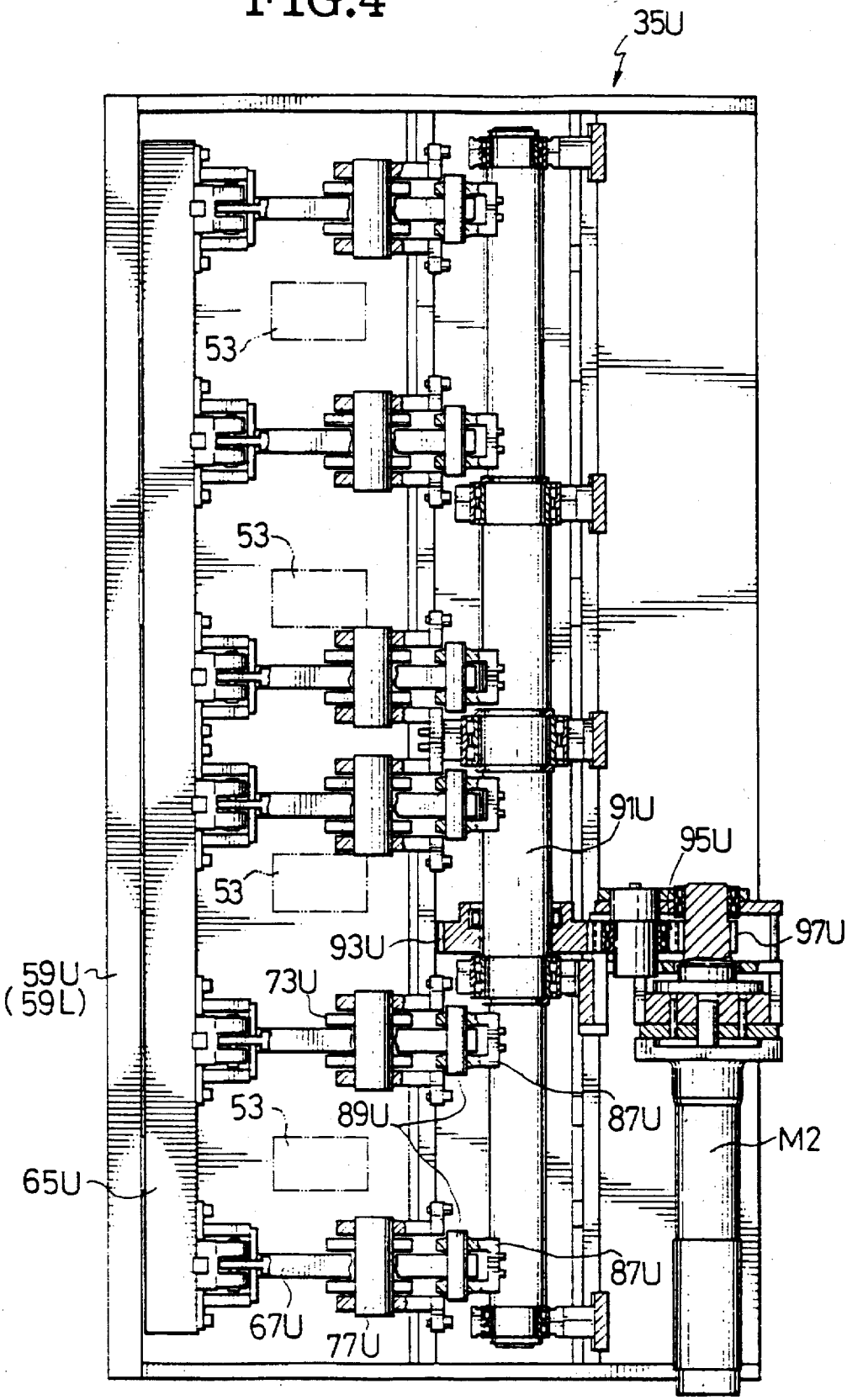
FIG. 4 is a sectional view of the plate material bending apparatus taken along the line 4—4 shown in FIG. 3.

In FIG. 3, the plate material bending apparatus 11B is constructed in such a way that an upper frame 35U is provided above the upper side of a box-shaped lower frame 35L so as to be movable in the vertical direction.

In more detail, a plurality of upper and lower hinge brackets 37U and 37L are arranged on the rear side (the right side in FIG. 3) of the upper and lower frames 35U and 3SL, respectively. The upper hinge bracket 37U is pivotally movable about a pivotal shaft 39.

In order to oscillate the upper frame 35U up and down about the pivotal shaft 39, a vertical movement motor M1 is mounted on the upper portion of the upper frame 35U. Further, a crank shaft 47 rotated by the motor M1 via an output gear 41, an intermediate gear 43 and a driven gear 45 is rotatably supported by a bracket 49 mounted on the upper portion of the upper frame 35U. Plural upper end portions of a plurality of roughly C-shaped connecting members 53 are linked via pins 55 to a plurality of crank arms 51 fixed to the crank shaft 47, respectively. On the other hand, plural lower end portions of the respective connecting members 53 are pivotally connected to the lower frame 35L via pins 57, respectively.

In the above-mentioned construction, therefore, when the motor M1 is driven to rotate the crank shaft 47 in the clockwise direction in FIG. 3, the upper frame 35U is oscillatorily moved about the pivotal shaft 39 in the vertical direction, so that the front side (the left side in FIG. 5) of the upper frame 35U is opened upward widely relative to the front side of the lower frame 35L.

Figure 5:
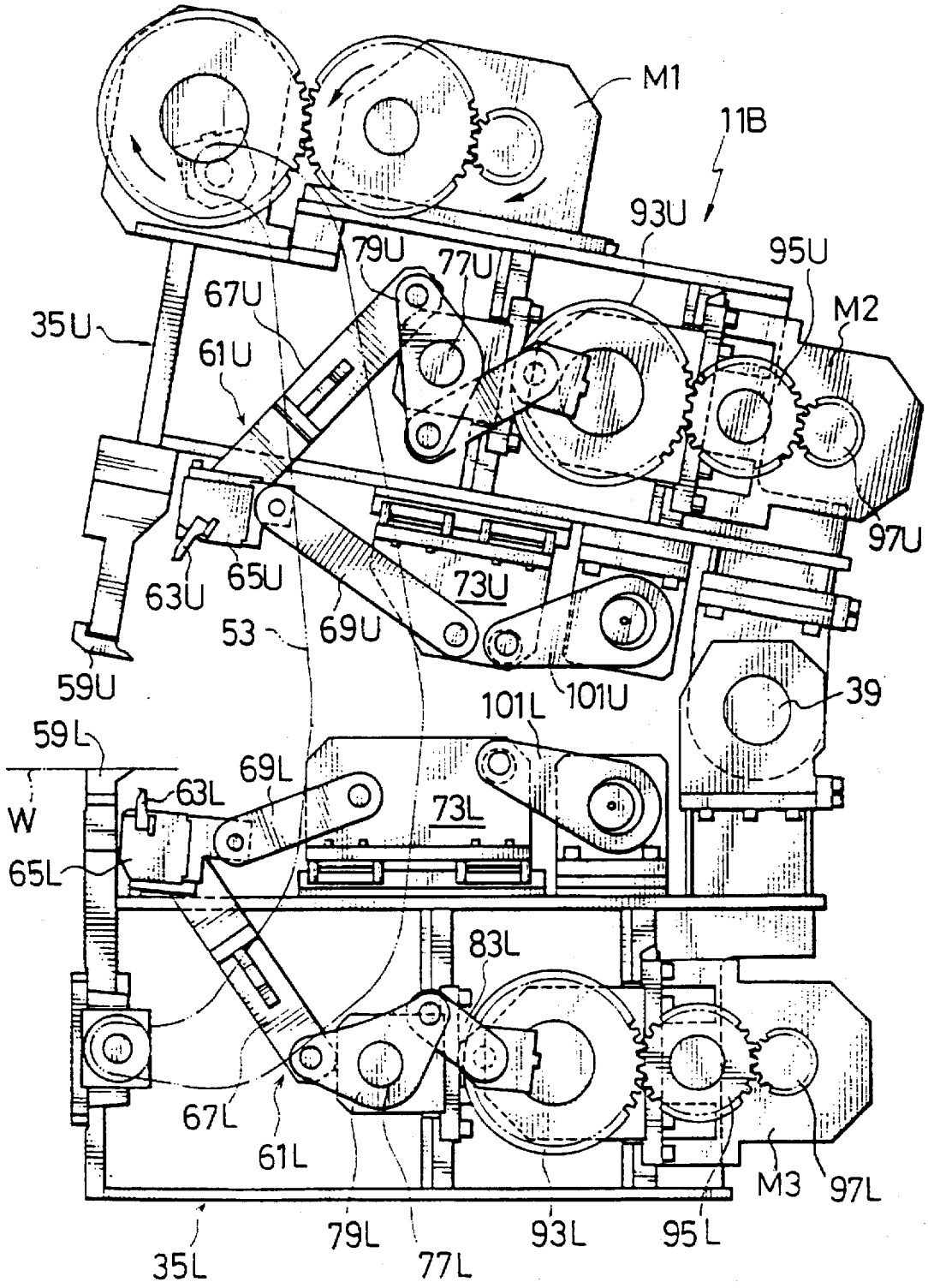
FIG. 5 is a side sectional view for assistance in explaining the vertical oscillating motion of the upper frame.

Further, when the motor M1 is rotated in the opposite direction, the upper frame 35U comes down from the state shown in FIG. 5 to the state shown in FIG. 3 to close the front side thereof relative to the front side of the lower frame 35L.

In order to grip a plate material W to be bent from above and below, an upper plate 59U extending in the direction perpendicular to the sheet of the paper in FIG. 3 is mounted on the front lower side of the upper frame 35U, and a lower plate 59L also extending in the same direction as the upper plate 59U is mounted on the front upper side of the lower frame 35L so as to oppose to the upper plate 59U.

Accordingly, when the upper frame 35U is oscillated in the vertical direction by driving the motor M1 as described above, it is possible to grip the plate material W to be bent from above and below and further to release the plate material W from the gripped condition.

In order to bend an end portion of the plate material W gripped between the upper and lower plates 59U and 59L in the upward direction, a lower bending mechanism 61L is provided on the lower frame 35L. In the same way, in order to bend an end portion of the plate material W in the downward direction, an upper bending mechanism 61U is provided on the upper frame 35U.

The upper bending mechanism 61U is provided with an upper die holder 65U for removably supporting an upper die 63U (which bends the end portion of the plate material W in the downward direction); the upper die holder 65U is movable up and down.

In more detail, the upper die holder 65U is provided so as to extend in parallel to the upper and lower plates 59U and 59L, and a plurality of holder brackets 67U each extending obliquely toward the rear and upper direction are provided on the upper side of the upper die holder 65U, respectively. Further, plural distal end portions of a plurality of upper guide links 69U for guiding the upward and downward oscillation of the upper die holder 65U are pivotally connected to the rear surface of the upper die holder 65U via hinge pins 71U at plural positions, respectively. On the other hand, plural base end portions of the respective upper guide links 69U are pivotally connected, via a pivotal shaft 75U, to a plurality of upper support brackets 73U attached to the lower surface of the upper frame 35U, respectively.

In order to move the upper die holder 65U up and down, an upper shaft 77U is rotatably supported by the upper frame 35U, and a plurality of bell cranks 79U are attached to the upper shaft 77U at plural positions, respectively. The end portions of the bell cranks 79U are pivotally connected to the upper end portions of the holder brackets 67U via pins 81U, respectively. On the other hand, the other end portions of the bell cranks 79U are pivotally connected to one end portions of a plurality of intermediate links 83U via pins 85U, respectively. Further, the other end portions of the intermediate links 83U are pivotally connected to a plurality of crank arms 87U via pins 89U, respectively.

The crank arms 87U are attached to a rotary shaft 91U rotatably supported by a plurality of brackets fixed to the upper frame 35U. A driven gear 93U provided on the rotary shaft 91U is in mesh with an intermediate gear 95U. Further, the output gear 97U of a motor M2 mounted on the upper frame 35U is in mesh with the intermediate gear 95U.

In the construction as described above, when the motor M2 is driven to rotate the rotary shaft 91U in the clockwise direction in FIG. 3, the bell cranks 79U are pivoted in the counterclockwise direction via the intermediate links 83U, so that the upper die holder 65U is moved in the downward direction.

When moved in the downward direction, the upper die holder 65U is moved down to near the plate material W by describing a large circular arc under the restriction of the upper guide links 69U. In this case, the length of the respective upper guide links 69U is extremely long in comparison with the thickness of the plate material W, so that the locus of the respective end portions of the respective upper guide links 69U is a part of an extremely large circular arc. Consequently, it may be considered that the respective upper guide links 69U move roughly in rectilinear motion, as depicted in FIG. 7.

Figure 7:
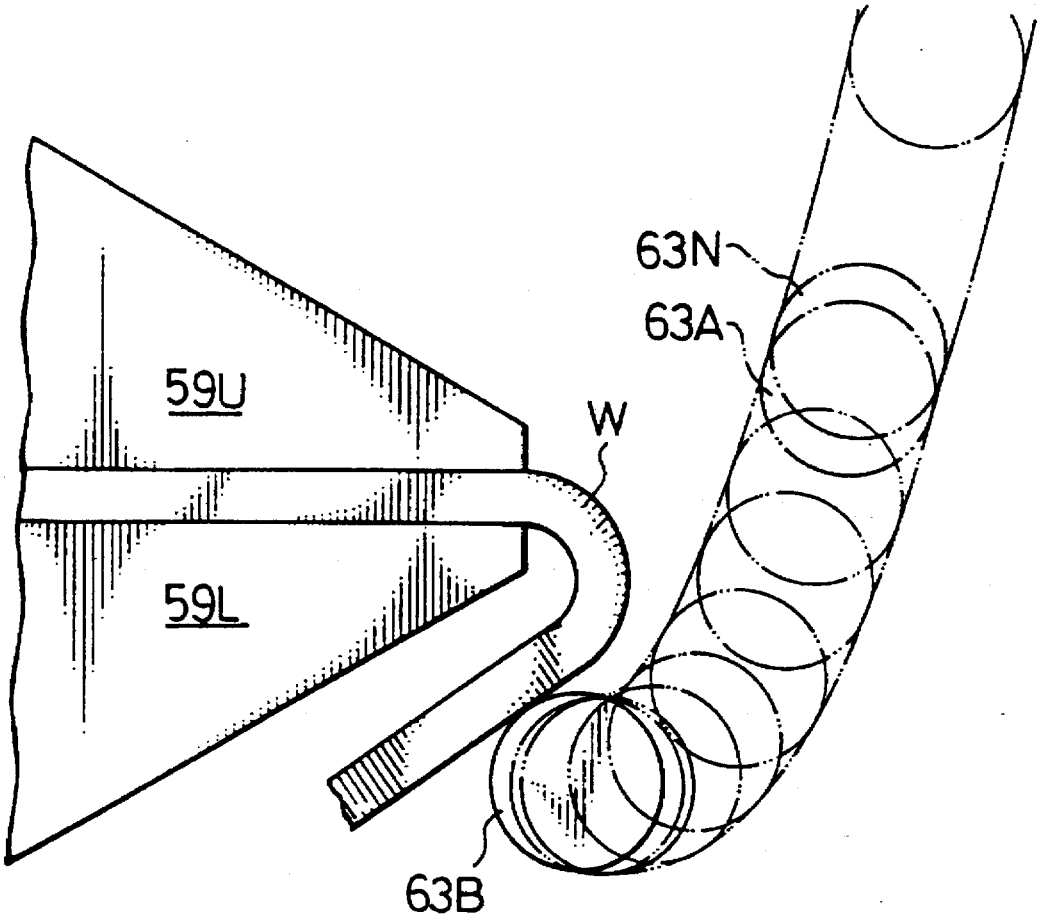
FIG. 7 is an illustration for assistance in explaining the locus of the end portion of the upper bending die.

After the bell crank 79U rotates to some extent and thereby the pin 81U reaches the position 81A as shown by a dashed circle in FIG. 3, the distal end portion 63N of the upper bending die 63U is located at a position 63A just before the die 63U is in contact with the plate material W, as depicted in FIG. 7. (In FIG. 7, note that since the cross-sectional shape of the distal end portion 63N of the bending die 63U is a small circular arc in shape, the locus of the end portion 63N thereof is described as the locus of a circle with a small radius.) At this point, the respective hinge pins 71U positioned at the front end portions of the upper guide links 69U are located at the position 71A as shown by a dashed circle in FIG. 3, respectively.

When the bell cranks 79U are further pivoted and therefore the pins 81U reach the position 81B as shown by a dashed circle in FIG. 3, the distal end portion 63N of the upper bending die 63N is located at the position 63B at which the end portion 63N is pivoted toward under the lower plate 59L, as shown in FIG. 7, so that the plate material is overbent beyond a bending angle of 90 degrees. Under these conditions, the hinge pins 71U are located at the position 71B as shown by a dashed circle shown in FIG. 3.

As understood by the above-mentioned construction, in the initial condition, the upper bending die 63U is located largely upward away from the bending position of the plate material W. However, at the bending position at which the upper bending die 63U bends the end portion of the plate material W in the downward direction, as depicted by dashed lines in FIG. 3, the upper guide links 69U roughly extends in the horizontal direction. Further, when the upper die holder 65U for supporting the upper bending die 63U is oscillated about the hinge pins 71U, the end portion 63N of the upper bending die 63U is pivoted to under the lower plate 59L along the locus as shown in FIG. 7.

In other words, in the present embodiment, since the upper bending mechanism 61U is constructed by use of a link mechanism, it is possible to largely retreat the upper bending die 63U from the bending position to the upward position, with the result that it is possible to increase the length of a upward flange portion of the plate material W, which flange portion is formed by a lower bending mechanism 61L that will be explained in the following.

When the flange portion of the plate material W is bent in the downward direction, the upper bending die 63U is moved in roughly rectilinear motion (along a large circular arc, accurately) from the upward retreat position to near the position just before the upper bending die 63U is in contact with the plate material W. Further, after the flange portion of the plate material W is bent, since the distal end portion 63N of the upper bending die 63U is moved around the pins 71U to under the lower plate 59L along a sharp curve for the overbending processing, it is possible to bend the plate material W accurately.

Further, when the lower bending mechanism 61L is driven by a motor M3 mounted on the lower frame 35L, the lower bending mechanism 61L can bend the end portion of the plate material W in the upward direction. This lower bending mechanism 61L is constructed in symmetrical positional relationship in the vertical direction with respect to the upper bending mechanism 61U, except that the length of the lower guide links 69L is shorter than that of the upper guide links 69U. Therefore the structural features and the functional effects of the lower bending mechanism 71L are the same as the upper bending mechanism 61U. Accordingly, the similar reference numerals have been retained for the similar composing elements which have the same functions, without repeating any detailed description of the construction and the operation of the lower bending mechanism 61L.

When the end portions of the plate materials W of different thicknesses are bent in accordance with the bending processing as described above, it is desirable to allow the clearance between the upper and lower plates 59U and 59L and the upper bending die 63U or 63L to be adjustable according to the thickness of the plate material W to be bent.

In this embodiment, therefore, the apparatus is provided with a clearance adjusting device for adjusting the above-mentioned clearance.

Figure 6:
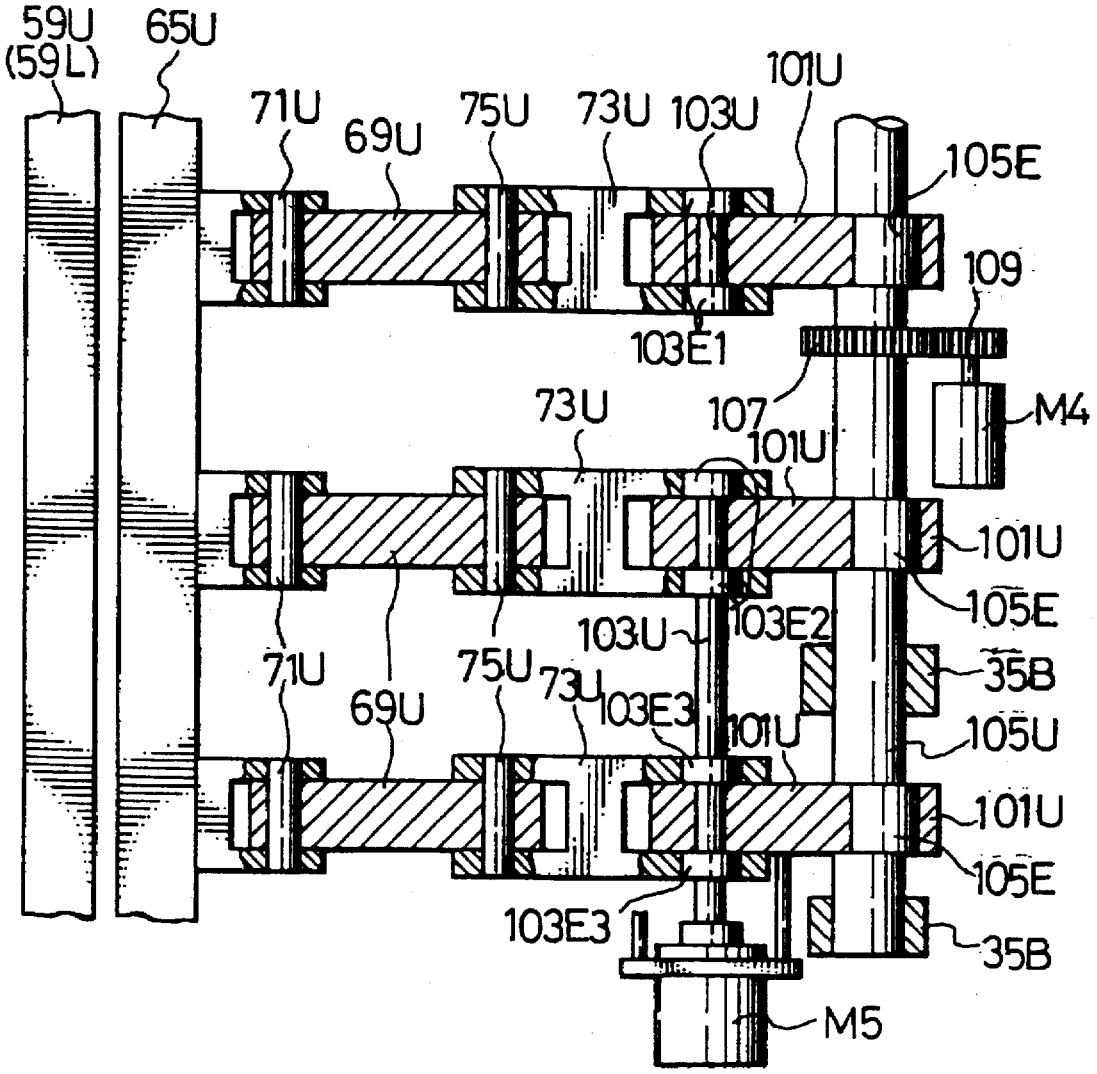
FIG. 6 is a sectional view taken along the line 6—6 shown in FIG. 3.

In more detail, the upper support brackets 73U for supporting the base portions of the upper guide links 69U, respectively are shiftable in the front and back direction (in the right and left direction in FIG. 3) while being guided by a plurality of guide members 99U fixed to the upper frame 35U, respectively. Further, as shown in FIG. 3 and FIG. 6, pivotally connected to the respective upper support brackets 73U via a pivotal shaft 103U are end portions of adjusting links 101U, respectively. The base portions of the respective adjusting links 101U are fitted to eccentric portions 105E of an adjusting shaft 105U pivotally supported on the brackets 35B mounted on the upper frame 35U, respectively.

Therefore, with reference to FIG. 6, when a motor M4 is driven, since the adjusting shaft 105U is rotated via an output gear 109 fixed to the motor M4 and a gear 107 fixed to the adjusting shaft 105U, the respective upper support brackets 73U are moved in the right and left direction in FIG. 3 and FIG. 6 by the eccentric rotation of the eccentric portions 105E.

Therefore, the upper die holder 65U is moved via the respective upper support brackets 73U and the upper guide links 69U in the right and left direction in FIG. 3 and FIG. 6, so that it is possible to adjust the clearance between the upper bending die 63U and the upper and lower plates 59U and 59L according to the thickness of the plate material W. Here, it should be noted that the amount of the back and forth movement of the upper die holder 65U for the clearance adjustment is so small in correspondence to change in thickness of the plate material W that this is not available for the overbending processing.

When the end portion of the plate material W is being bent upward or downward as described above, the upper or lower bending die 63U or 63L is subjected to a horizontal component of a reaction force generated when the plate material W is being bent. Therefore, there exists a tendency that the longitudinal middle portion of the upper or lower bending die 63U or 63L is curved or deflected so as to be moved away from the upper and lower plates 59U and 59L due to the horizontal component force. This flection tendency is prominent, when the width of the plate material W is narrow in comparison with the length of the upper and lower bending die 63U or 63L, and further the horizontal component force is applied to only near the middle portion of the upper and lower bending die 63U and 63L.

To overcome the above-mentioned problem, the apparatus of the present invention is provided with a deflection compensation device whereby the upper or lower bending die 63U or 63L is previously bent in the direction opposite to the direction of the above-mentioned flection in order to compensate for the deflection or flection of the bending die 63U or 63L generated while the plate material W is being bent.

In more detail, as shown in FIG. 3 and FIG. 6, the pivotal shafts 103U for connecting the adjusting links 101U and the upper support brackets 73U, respectively are formed with an eccentric portion 103E, respectively. The eccentricity rates of the eccentric portions 103E differ from each other, in such away that the eccentricity rate of the eccentric portion 103 E1 at the longitudinal center portion of the adjusting shaft 105U is zero; and that 103 E3 at the longitudinal outer side portion thereof is larger than that 103 E2 at the longitudinal inner side portion thereof.

The eccentric directions of the respective eccentric portions 103 E2 and 103 E3 are the same (for instance, in the upward or downward direction). When the pivotal shaft 71U is rotated by an appropriate motor MS, the respective upper support brackets 73U are slightly moved in the back and forth direction relative to the adjusting link 101U in FIG. 3 and FIG. 6. in this movement, since the eccentricity rates of the respective eccentric portions 103 E1 to E3 differ from each other, the shift rate of the respective support brackets 73U differ from each other, with the result that it is possible to deform the upper die holder 65U in such a way that the longitudinal middle portion of the upper die holder 65U is projected toward the upper and lower plates 59U and 59L.

Therefore, it is possible to compensate for the deflection or flection of the upper die holder 65U to produced by the horizontal component force generated during bending, thus realizing a more precise bending processing of the plate material W.

Further, in this embodiment, the flection correction of the upper die holder 65U by the pivotal motion of the pivotal shaft 103U can be adjusted to any required flection rate by adjusting the pivotal angle of the pivotal shaft 103U.

Further, the flection of the lower die holder 65L can be adjusted in the same way as with the case of the upper die holder 65U. Accordingly, the similar reference numerals have been retained for the similar composing elements which have the same functions, without repeating any detailed description of the construction and the operation thereof.

As understood by the description of the above-mentioned embodiment, in the bending apparatus according to the present invention, since the upper and lower bending mechanisms 61U and 61L are constructed by a link mechanism, respectively, it is possible to move the upper or lower bending die 63U or 63L far away from the bending position of the plate material W.

Further, since the locus of the upper or lower bending die 63U or 63L is rectilinear at least to the position just before the die is in contact with the plate material W, and is along a sharp curve after the die contacts the plate material W for overbending processing, it is possible to achieve the bending of the plate material W at a high precision.

Further, the clearance between the upper and lower plates 59U, 59L and the upper or lower bending die 63U or 63L can be adjusted according to the thickness of the plate material W and additionally the flection of the upper or lower bending die 63U or 63L can be previously deformed for the compensation, it is possible to more accurately bend the plate material.

Further, according to the bending press system, since the two opposing sides of the plate material W can be bent by the two opposing bending apparatuses 9A and 9B or 11A and 11B arranged on both sides of the first or second bending line 3 or 5, respectively, it is possible to bend the plate material W quickly without reversing the front and rear direction of the plate material W.

Further, since any one pair of the two opposing sides of the plate material W can be bent by the first bending line 3 and the other pair of the two opposing sides thereof can be bent by the second bending line 5, it is possible to freely determine the bending sequence of the long and short sides of the plate material W.

What is claimed is:

1. A plate material bending apparatus, comprising:

a lower frame;

an upper frame supported by said lower frame so as to be movable up and down;

an upper bending mechanism mounted on said upper frame, the upper bending mechanism including an upper bending die for downward bending a plate material gripped between a lower plate provided on said lower frame and an upper plate provided on said upper frame, and a pivotal link for moving said upper bending die upward and downward;

a lower bending mechanism mounted on said lower frame, said lower bending mechanism including a lower bending die for upward bending the plate material, and a pivotal link for moving said lower bending die upward and downward, said upper bending die being movable relative to said lower bending die;

a deflection compensation means for compensating deflection to be generated in said upper and lower dies during the plate material bending by said upper and said lower bending dies being bent in a direction opposite a bending direction.

2. The plate material bending apparatus of claim 1, further comprising a clearance adjusting apparatus for adjusting a clearance between said upper or lower plate and said upper or lower bending die according to a thickness of the plate material to be bent.

3. A bending apparatus for bending a plate material comprising:

a lower frame;

an upper frame provided for said lower frame so as to be movable up and down;

a lower plate mounted on said lower frame;

an upper plate mounted on said upper frame to grip the plate material in cooperation with said lower plate;

an upper bending die for downward bending an end portion of the plate material gripped between said upper and lower plates;

an upper die holder for holding said upper bending die;

a plurality of upper guide links oscillatorily movable up and down, end portions of said upper guide links being pivotally connected by a first connecting shaft to a lower portion of said upper die holder, respectively;

a plurality of upper crank arms pivotally connected to an upper portion of said upper die holder, for moving said upper die holder up and down; and an upper driving device for moving said respective upper crank arms;

wherein when said respective upper crank arms are moved, said upper die holder is moved down while being guided by said respective upper guide links, to bend the end portion of the plate material downward; and when said respective upper crank arms are further moved in the same direction, an end portion of said upper bending die is pivoted about said first connecting shaft toward under said lower plate to overbend the plate material; and said apparatus further comprising:

a lower bending die for upward bending the end portion of the plate material gripped between said upper and lower plates;

a lower die holder for holding said lower bending die;

a plurality of lower guide links oscillatorily movable up and down, end portions of said lower guide links being pivotally connected by a second connecting shaft to an upper portion of said lower die holder, respectively;

a plurality of lower crank arms pivotally connected to a lower portion of said lower die holder, for moving said lower die holder up and down; and a lower driving device for moving said respective lower crank arms;

wherein when said respective lower crank arms are moved, said lower die holder is moved upward while being guided by said respective lower guide links, to bend the end portion of the plate material upward; and when said respective lower crank arms are further pivoted in the same direction, an end portion of said lower bending die is pivoted about said second connecting shaft toward above said upper plate to overbend the plate material; and wherein a length of said upper guide links is longer than that of said lower guide links, and an upward movement stroke of said upper die holder is longer than a downward movement stroke of said lower die holder.

4. A bending apparatus for bending a plate material comprising:

a lower frame;

an upper frame provided for said lower frame so as to be movable up and down;

a lower plate mounted on said lower frame;

an upper plate mounted on said upper frame to grip the plate material in cooperation with said lower plate;

an upper bending die for downward bending an end portion of the plate material gripped between said upper and lower plates;

an upper die holder for holding said upper bending die;

a plurality of upper guide links oscillatorily movable up and down, end portions of said upper guide links being pivotally connected by a first connecting shaft to a lower portion of said upper die holder, respectively;

a plurality of upper crank arms pivotally connected to an upper portion of said upper die holder, for moving said upper die holder up and down; and an upper driving device for moving said respective upper crank arms;

wherein when said respective upper crank arms are moved, said upper die holder is moved down while being guided by said respective upper guide links, to bend the end portion of the plate material downward; and when said respective upper crank arms are further moved in the same direction, an end portion of said upper bending die is pivoted about said first connecting shaft toward under said lower plate to overbend the plate material;

said apparatus further comprising:

a lower bending die for upward bending the end portion of the plate material gripped between said upper and lower plates;

a lower die holder for holding said lower bending die;

a plurality of lower guide links oscillatorily movable up and down, end portions of said lower guide links being pivotally connected by a second connecting shaft to an upper portion of said lower die holder, respectively;

a plurality of lower crank arms pivotally connected to a lower portion of said lower die holder, for moving said lower die holder up and down; and a lower driving device for moving said respective lower crank arms;

wherein when said respective lower crank arms are moved, said lower die holder is moved upward while being guided by said respective lower guide links, to bend the end portion of the plate material upward; and when said respective lower crank arms are further pivoted in the same direction, an end portion of said lower bending die is pivoted about said second connecting shaft toward above said upper plate to overbend the plate material;

an upper clearance adjusting device for adjusting a clearance between said upper and lower plates and the upper bending die according to thickness of the plate material to be bent, said upper clearance adjusting device including a plurality of upper support brackets slidably provided on said upper frame and base portions of a plurality of said upper guide links being pivotally connected to the upper support brackets, respectively; and a lower clearance adjusting device for adjusting a clearance between said upper and lower plates and said lower bending die according to thickness of the plate material to be bent, said lower clearance adjusting device including a plurality of lower support brackets slidably provided on said lower frame and base portions of a plurality of said lower guide links being pivotally connected to said lower support brackets.

5. A bending apparatus for bending a plate material comprising:

a lower frame;

an upper frame provided for said lower frame so as to be movable up and down;

a lower plate mounted on said lower frame;

an upper plate mounted on said upper frame to grip the plate material in cooperation with said lower plate;

an upper bending die for downward bending an end portion of the plate material gripped between said upper and lower plates;

an upper die holder for holding said upper bending die;

a plurality of upper guide links oscillatorily movable up and down, end portions of said upper guide links being pivotally connected by a first connecting shaft to a lower portion of said upper die holder, respectively;

a plurality of upper crank arms pivotally connected to an upper portion of said upper die holder, for moving said upper die holder up and down; and an upper driving device for moving the respective upper crank arms;

wherein when said respective upper crank arms are moved, said upper die holder is moved down while being guided by said respective upper guide links, to bend the end portion of the plate material downward; and when said respective upper crank arms are further moved in the same direction, an end portion of said upper bending die is pivoted about the first connecting shaft toward under said lower plate to overbend the same plate material;

said apparatus further comprising:

a lower bending die for upward bending the end portion of the plate material gripped between said upper and lower plates;

a lower die holder for holding said lower bending die;

a plurality of lower guide links oscillatorily movable up and down, end portions of said lower guide links being pivotally connected by a second connecting shaft to an upper portion of said lower die holder, respectively;

a plurality of lower crank arms pivotally connected to a lower portion of said lower die holder, for moving said lower die holder up and down;

a lower driving device for moving the respective lower crank arms;

wherein when said respective lower crank arms are moved, said lower die holder is moved upward while being guided by said respective lower guide links, to bend the end portion of the plate material upward; and when said respective lower crank arms are further pivoted in the same direction, an end portion of said lower bending die is pivoted about the second connecting shaft toward above said upper plate to overbend the same plate material;

an upper deflection compensation device for deforming said upper bending die so that deflection produced during bending is compensated, said upper deflection compensation device including a plurality of upper support brackets mounted on said upper frame so as to be slidably mounted on said upper frame independently and base portions of a plurality of said upper guide links being pivotally connected to said upper support brackets; and a lower deflection compensation device for deforming said lower bending die so that deflection produced during bending is compensated, said lower deflection compensation device including a plurality of said lower frame independently and base portions of a plurality of said lower guide links being pivotally connected to said lower support brackets, respectively.

6. A bending press comprising:

a lower frame;

an upper frame pivotally supported by said lower frame;

an upper bending mechanism mounted on said upper frame, the upper bending mechanism including an upper bending die for downward bending a plate material gripped between a lower plate provided on said lower frame and an upper plate provided on said upper frame, and an upper link mechanism for moving said upper bending die upward and downward, said upper link mechanism including first means connected to said upper bending die for imparting a generally downward bending force to the upper bending die; and an upper guide link pivotally connected to said upper bending die at a first end and pivotally connected to said upper frame at a second end;

a lower bending mechanism mounted on said lower frame, the lower bending mechanism including a lower bending die for upward bending the plate material, and a lower link mechanism for moving said lower bending die upward and downward, said lower link mechanism including second means connected to said lower bending die for imparting a generally upward bending force to said lower bending die; and a lower guide link pivotally connected to said lower bending die at a first end and pivotally connected to said lower frame at a second end;

wherein a length of said upper guide link is longer than a length of said lower guide link such that an upward movement stroke of said upper die is longer than a downward movement stroke of said lower die.

7. The bending press according to claim 6, wherein said upper frame is moved upward and downward, relative to said lower frame, by a link mechanism actuated by crank.

8. A plate material bending system, comprising:

a first bending line for conveying a plate material in a first direction;

a second bending line for conveying the plate material in a second direction perpendicular to the first direction;

a plate material feeding apparatus for feeding the plate material from the first bending line to the second bending line without changing direction of the plate material;

a pair of first bending apparatuses opposingly arranged on both sides of said first bending line, so as to be movable toward and away from each other, for bending one pair of two opposing sides of the plate material; and a pair of second bending apparatuses opposingly arranged on both sides of said second bending line, so as to be movable toward and away from each other, for bending the other pair of two opposing sides of the plate material, and wherein each of said respective bending apparatuses comprises:

an upper bending die for downwardly bending both ends of the plate material gripped between upper and lower plates provided for upper and lower frames, respectively, and a lower bending die for upwardly bending both ends of the plate material; and upper and lower bending mechanisms each including a link mechanism for moving said upper bending die or said lower bending die in both upward and downward directions, respectively.

9. A bending apparatus for bending a plate material, comprising:

a lower frame;

an upper frame provided for said lower frame so as to be movable up and down;

a lower plate mounted on said lover frame;

an upper plate mounted on said upper frame to grip the plate material in cooperation with said lower plate;

an upper bending die for downwardly bending an end portion of the plate material gripped between said upper and lower plates;

an upper die holder for holding said upper bending die;

a plurality of upper guide links oscillatorily movable up and down, end portions of said upper guide links being pivotally connected by a first connecting shaft to a lower portion of said upper die holder, respectively;

a plurality of upper crank arms pivotally connected to an upper portion of said upper die holder, for moving said upper die holder up and down; and an upper driving device for moving said respective upper crank arms, and wherein when said respective upper crank arms are moved, said upper die holder is moved down while being guided by said respective upper guide links, to bend the end portion of the plate material downward; and when said respective upper crank arms are further moved in the same direction, an end portion of said upper bending die is pivoted about said first connecting shaft toward under said lower plate to overbend the plate material; and said apparatus further comprising:

a lower bending die for upward bending the end portion of the plate material gripped between said upper and lower plates;

a lower die holder for holding said lower bending die;

a plurality of lower guide links oscillatorily movable up and down, end portions of said lower guide links being pivotally connected by a second connecting shaft to an upper portion of said lower die holder, respectively;

a plurality of lower crank arms pivotally connected to a lower portion of said lower die holder, for moving said lower die holder up and down; and a lower driving device for moving said respective lower crank arms, and wherein when said respective lower crank arms are moved, said lower die holder is moved upward while being guided by said respective lower guide links, to bend the end portion of the plate material upward; and when said respective lower crank arms are further pivoted in the same direction, an end portion of said lower bending die is pivoted about said second connecting shaft toward above said upper plate to overbend the plate material.

10. A bending press comprising:

a lower frame;

an upper frame pivotally supported by said lower frame;

an upper bending mechanism mounted on said upper frame, the upper bending mechanism including an upper bending die for downwardly bending a plate material gripped between a lower plate provided on said lower frame and an upper plate provided on said upper frame, and an upper link mechanism for moving the upper bending die upward and downward, the upper link mechanism including:

a upper holder bracket connected to the upper bending die for imparting a generally downward bending force to the upper bending die; and an upper guide link pivotally connected to the upper bending die at a first end of the upper guide link and pivotally connected to the upper frame at a second end of the upper guide link;

a lower bending mechanism mounted on said lower frame, the lower bending mechanism including a lower bending die for upwardly bending the plate material, and a lower link mechanism for moving the lower bending die upward and downward;

the lower link mechanism including:

a lower holder bracket connected to the lower bending die for imparting a generally upward bending force to the lower bending die; and a lower guide link pivotally connected to the lower bending die at a first end of the lower guide link and pivotally connected to the lower frame at a second end of the lower guide link, wherein a length of the upper guide link is longer than that of the lower guide link such that an upward movement stroke of the upper die is longer than a downward movement stroke of the lower die.

* * * * *